US007192037B1

(12) United States Patent
Peña

(10) Patent No.: US 7,192,037 B1
(45) Date of Patent: Mar. 20, 2007

(54) LID ASSEMBLY AND METHOD OF USE

(76) Inventor: Christopher Peña, P.O. Box 206, San Juan, TX (US) 78589

( * ) Notice: Subject to any disclaimer, the term of this patent is extended or adjusted under 35 U.S.C. 154(b) by 16 days.

(21) Appl. No.: 11/111,611

(22) Filed: Apr. 21, 2005

Related U.S. Application Data

(60) Provisional application No. 60/565,186, filed on Apr. 26, 2004.

(51) Int. Cl.
*A47L 13/52* (2006.01)

(52) U.S. Cl. ..... 280/47.26; 15/257.3; 294/1.1

(58) Field of Classification Search ..... 280/47.26; 220/371, 4.28, 263, 264; 141/108, 390, 391; 15/257.1, 257.3; 248/99; 294/1.1
See application file for complete search history.

(56) References Cited

U.S. PATENT DOCUMENTS

| | | | | | |
|---|---|---|---|---|---|
| 4,442,567 | A | * | 4/1984 | Pravettone | 15/257.4 |
| 4,600,113 | A | * | 7/1986 | DeMars | 220/212 |
| 4,795,046 | A | | 1/1989 | Rath | |
| 4,802,258 | A | | 2/1989 | Jensen | |
| 4,890,733 | A | * | 1/1990 | Anderson | 206/365 |
| 5,080,251 | A | * | 1/1992 | Noack | 206/366 |
| 5,511,807 | A | * | 4/1996 | Snyder | 280/47.26 |
| 5,647,502 | A | * | 7/1997 | Marsh | 220/481 |
| 5,730,451 | A | * | 3/1998 | Walker | 280/47.26 |
| 5,899,468 | A | * | 5/1999 | Apps et al. | 280/47.26 |
| 6,082,574 | A | | 7/2000 | Johnson | |
| 6,120,743 | A | * | 9/2000 | Papari | 422/300 |
| 6,145,856 | A | * | 11/2000 | Conti | 280/47.26 |
| 6,761,367 | B2 | * | 7/2004 | Fite | 280/47.26 |
| 6,953,199 | B2 | * | 10/2005 | Malloy, III | 280/47.26 |
| 6,974,167 | B2 | * | 12/2005 | Springs, II | 294/1.1 |
| 2005/0016999 | A1 | * | 1/2005 | Richardson et al. | 220/4.28 |
| 2005/0217214 | A1 | * | 10/2005 | Richardson et al. | 53/459 |

FOREIGN PATENT DOCUMENTS

| | | | |
|---|---|---|---|
| FR | 2654083 | * | 5/1991 |
| GB | 2102352 | * | 2/1983 |

* cited by examiner

*Primary Examiner*—J. Allen Shriver

(57) ABSTRACT

A lid assembly and method for removing articles from a floor. The lid assembly includes a lid assembly base structure, a fastening device for securing the lid assembly base structure to a storage cart, and a platform riser that forms a support platform at a distal end. The lid assembly further includes a collector arrangement. The collector arrangement is pivotally attached to the support platform and includes a collection panel. With the collection panel, the collector arrangement provides a convenient method for quickly gathering large quantities of articles from the floor and directing them entirely to a storage cart. Operatively, in a retracted position, the collection panel covers an opening through the storage cart. Alternatively, in an extended position as the storage cart is oriented in a horizontal position in contact with the floor, the collection panel exposes the opening through the storage cart and defines a pathway for directing articles from the floor, upwardly across the collection panel, downwardly to the lid assembly base structure, and through the opening. In one exemplary embodiment, a lid assembly is integral to a collection system for receiving articles.

12 Claims, 4 Drawing Sheets

LID ASSEMBLY AND METHOD OF USE

CROSS REFERENCE TO RELATED APPLICATIONS

This application is related to and claims benefit under 35 U.S.C. §119(e) from prior U.S. Provisional Patent Application Ser. No. 60/565,186 filed on Apr. 26, 2004 entitled "Industrial & Residential Trash-Pan", by inventor Christopher Peña, the entire disclosure of which is hereby incorporated by reference as if fully set forth herein.

BACKGROUND OF THE INVENTION

1. Field of the Invention

The present invention generally relates to a lid assembly for attachment to a storage cart. More particularly, but not by way of limitation, the present invention relates to a system and a method for establishing a pathway that directs articles from a floor across a lid assembly to a storage cart, such as for collecting waste or recyclable materials.

2. Description of the Related Art

Many typical storage carts, such as waste collection bins or recyclable materials carts, are rectangular, plastic containers having two wheels. Moreover, storage carts may be hitched for tandem movement and may also feature stackable properties. Often storage carts have large volumetric capacities. Accordingly, integrating two wheels with most storage carts provides a preferred means for transport as opposed to lifting the entire storage cart over long distances. The typically rectangular shape provides an accommodating configuration for use with most automated hydraulic lifter trucks. Illustratively, a storage cart may comprise a standard 96 gallon, two wheeled waste storage cart. Waste is often collected for a period. Subsequently, the waste storage cart is heavy when full and is thus rolled curbside in an upright position for pickup. A side-loading, automated garbage truck having hydraulic lifts that best conform to its rectangular shape lifts, empties, and returns the waste storage cart to its curbside location for future collection.

Storage carts are used in a wide variety of applications. Illustratively, storage carts may be used in food service, health care institutional, industrial, maintenance and custodial, as well as document shredding and recycling applications. For example, in an industrial steel mill, bits of scrap metal are collected from the floor and placed in a storage cart. Specifically, scrap metal is gathered on the floor, collected in shovels or dust pans, lifted, and placed within the vertically positioned storage bin. Unfortunately, scrap metal may be hot, sharp, heavy, and difficult to manage while transferred from the floor to the storage cart. In another example, cleaning up litter after a large public event, such as an entertainment event, is quite difficult due to the limited holding capacity afforded by standard dust pans for transferring litter from the ground to an upright storage cart. At times, transferring material from the floor to the upright storage cart can be cumbersome, messy, and potentially hazardous. Unfortunately, there is no known device or method for neatly and safely transferring large volumes of articles from a floor to a storage cart.

Therefore, a need exists for a system and method for neatly, quickly, and safely transferring large volumes of material into a storage cart. Many other problems and disadvantages of the prior art will become apparent to one skilled in the art after comparing such prior art with the present invention as herein described.

SUMMARY OF THE INVENTION

Aspects of the invention are found in lid assembly and method for removing articles from a floor. The lid assembly may be integrated with standard two wheeled carts while providing a pathway for directing articles from the floor through the lid assembly to the storage cart. The storage cart forms an opening for receiving articles. In one aspect, the lid assembly includes a lid assembly base structure and a fastening device for securing the lid assembly base structure to the storage cart. The lid assembly includes a platform riser that forms a support platform at a distal end. The lid assembly further includes a collector arrangement. The collector arrangement is pivotally attached to the support platform and includes a collection panel. With the collection panel, the collector arrangement provides a convenient method for quickly gathering large quantities of articles from the floor and directing them entirely to a storage cart.

Operatively, in a retracted position, the collection panel covers the opening through the storage cart. Alternatively, in an extended position, the collection panel exposes the opening through the storage cart and defines a pathway for directing articles from the floor upwardly across the collection panel, downwardly to the lid assembly base structure, and through the opening.

In one aspect, the lid assembly is integral to a collection system for receiving articles. The collection system further includes a container assembly having a container body. The container body includes a storage chamber defining an opening for receiving articles. In one aspect, the container body forms a tilt glide for orienting the collection system in either a horizontal or a vertical position. In one aspect, the container assembly further includes a step-on lever coupled to the container body. For the entire collection system, the step-on lever facilitates ease of transition between a horizontal and a vertical position. Moreover, the container body may include an access door to the storage chamber.

In one aspect, a method for removing articles from a floor into a storage cart includes orienting the storage cart in a horizontal position and in contact with the floor whereby the storage cart is coupled to a lid assembly. Accordingly, a collector panel is arranged in an extended position. Thereafter, a pathway is established for directing articles from the floor upwardly across the collector panel, through the lid assembly, to the storage cart. Other aspects, advantages, and novel features of the present invention will become apparent from the detailed description of the present invention when considered in conjunction with the accompanying drawings

BRIEF DESCRIPTION OF THE DRAWINGS

The present invention is illustrated by way of example and not by limitation in the accompanying figures, in which like references indicate similar elements, and in which.

Skilled artisans appreciate that elements in the Figures are illustrated for simplicity and clarity and have not necessarily been drawn to scale. For example, the dimensions of some of the elements in the Figures may be exaggerated relative to the other elements to help improve understanding of the embodiments of the present invention.

DETAILED DESCRIPTION

For a more complete understanding of the present invention, preferred embodiments of the present invention are illustrated in the Figures. Like numerals being used to refer to like and corresponding parts of the various accompanying drawings. It is to be understood that the disclosed embodiments are merely exemplary of the invention, which may be embodied in various forms.

Figure 1:
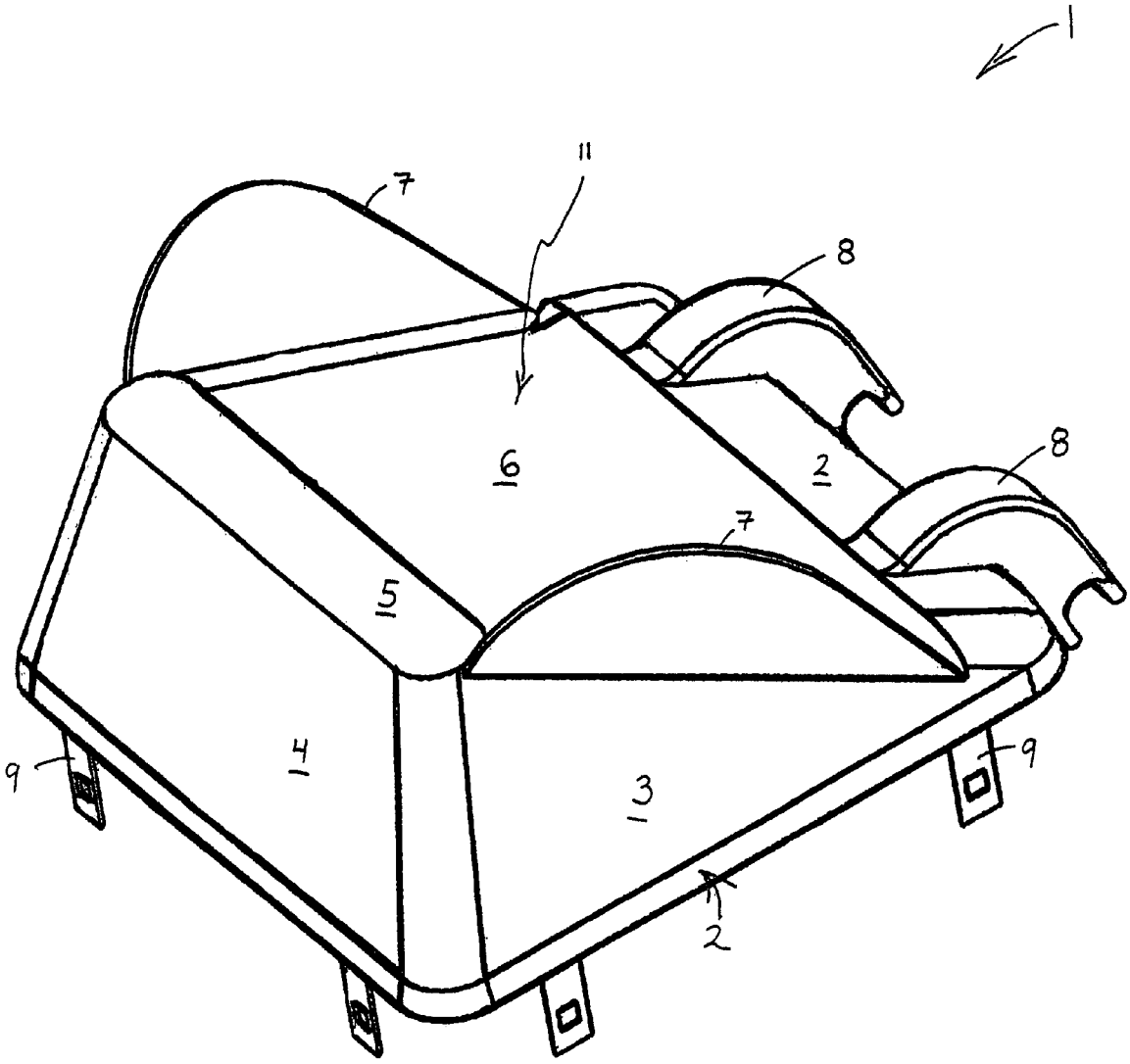
FIG. 1 is an isometric view illustrating a lid assembly for attachment to a storage cart according to the present invention, the lid assembly featuring a collection panel for directing articles to the storage cart while in an extended position.

FIG. 1 illustrates one aspect, among others, of a lid assembly 1 for attachment to a storage cart (not shown). Generally, as the storage cart is oriented in a horizontal position in contact with the floor, the lid assembly 1 forms a pathway for directing articles from the floor, through the lid assembly 1 to the storage cart for collection therein. Illustratively, FIGS. 6 and 7 each show at least one exemplary embodiment of a collection system having a lid assembly for operatively removing articles from a floor. In this disclosure and appended claims, the term "articles" refers to objects for storage such as waste material including medical waste, lawn and gardening material including leaves, mulch, and soil, food material, and industrial material such as ball bearings, metal and wood shavings. Moreover, the storage cart may be any suitable cart of a type well known in the industry, such as thirty (30) through ninety-six (96) gallon waste carts having either no wheels or at least two wheels.

Specifically referring to FIG. 1, the lid assembly 1 includes a lid assembly base structure 2. Generally, the lid assembly base structure 2 is configured to conform to an opening formed by the storage cart. In operation, the lid assembly base structure 2 is positioned against the storage cart opening while structurally supporting the lid assembly 1.

The lid assembly 1 includes a fastening device 9 for securing the lid assembly base structure 2 to the storage cart. Generally, the fastening device 1 may be any suitable device of a type well known in the industry for ensuring that the lid assembly 1 is secured to the storage container at the opening. For example, the fastening device may comprise an adhesive, a sleeve that extends downwardly through the opening and fixedly abuts against the storage container, and a fastener and mounting assembly as shown in FIG. 1. Alternatively, in one exemplary embodiment, a lid assembly and storage container may be formed from one integral piece.

As shown in FIG. 1, the lid assembly 1 includes a platform riser 4. The platform riser 4 extends outwardly from the lid assembly 1 toward the center of the lid assembly base structure 2. As shown in FIG. 1, the platform riser 4 slants inwardly as it extends from the lid assembly base structure 2. As shown in FIG. 1, the platform riser 4 includes a distal end opposingly located from the juncture of the platform riser 4 and the lid assembly base structure 2.

The platform riser 4 forms a support platform 5 at the distal end. In FIG. 1, as it extends toward the center of the lid assembly base structure 2, the support platform 5 is positioned in parallel with the lid assembly base structure 2. In one exemplary embodiment, the support platform 5 is positioned substantially parallel to the lid assembly base structure 2.

Similarly, the lid assembly 1 includes a pair of panel risers 3 each extending outwardly from the lid assembly base structure 2 toward the center of the lid assembly base structure 2. Furthermore, as shown, each panel riser 3 is coupled to the platform riser 4 at opposing ends of the platform riser 4.

The lid assembly 1 further includes a collector arrangement 11. The collector arrangement 11 includes a collection panel 6. The collection panel 6 is secured to the support platform 5 and sits on the pair of panel risers 3 as shown in FIG. 1. In one exemplary embodiment, the collection panel 6 is pivotally attached to the support platform 5.

Figure 7:
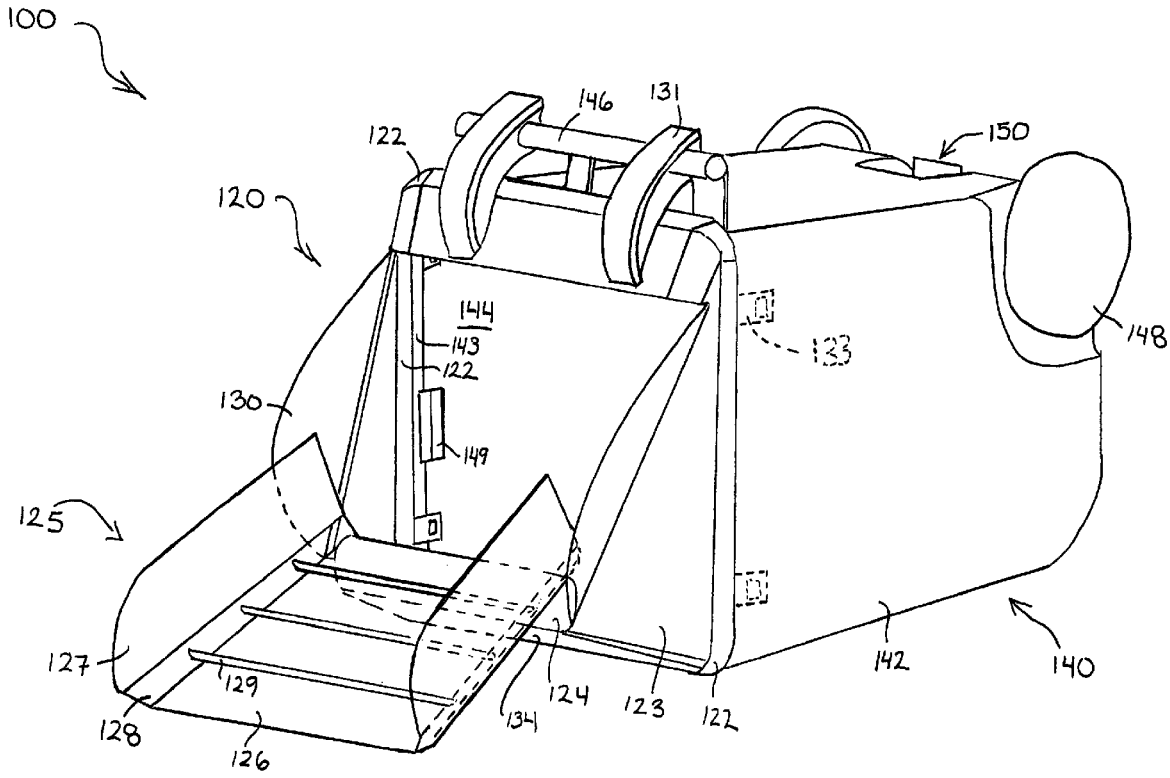
FIG. 7 is an isometric view from the side illustrating a collection system in a horizontal position having a lid assembly coupled to a container assembly as shown in an extended position, the lid assembly includes a collection panel for establishing a pathway to the container assembly.

Operatively, in a retracted position, the collection panel 6 enables the lid assembly 1 to cover the opening formed by the storage cart attached to the lid assembly 1. As the collection panel 6 covers the opening, articles are prevented from entering the opening. Alternatively, in an extended position, the collection panel 6 exposes the opening and defines a pathway for directing articles from the collection panel 6 through the lid assembly base structure 2 to the opening as illustrated in FIG. 7.

In effect, the inward slant provided by the platform riser 3 and the parallel positioning of the support platform 5 with respect to the lid assembly base structure 2 functions as a barrier for confining the movement of articles along a one-way path. Specifically, as opposed to escaping back through the collection panel 6, the inward slant provided by the platform riser 3 and parallel positioning of the support platform 5 enables various articles to slide downwardly along the platform riser 4 to the opening. Therefore, in operation, articles are directed along a pathway from the floor upwardly across the collection panel 6, downwardly from the support platform 5, downwardly across the platform riser 4 and the lid assembly base structure 2 to the opening of the storage cart for storage therein. As it is positioned in parallel with the lid assembly base structure 2, the support platform 5 elevates the collection panel 6 far above the floor so as to facilitate a ramp-like effect for the collection panel 6 and to provide a barrier for one-way article movement.

Figure 6:
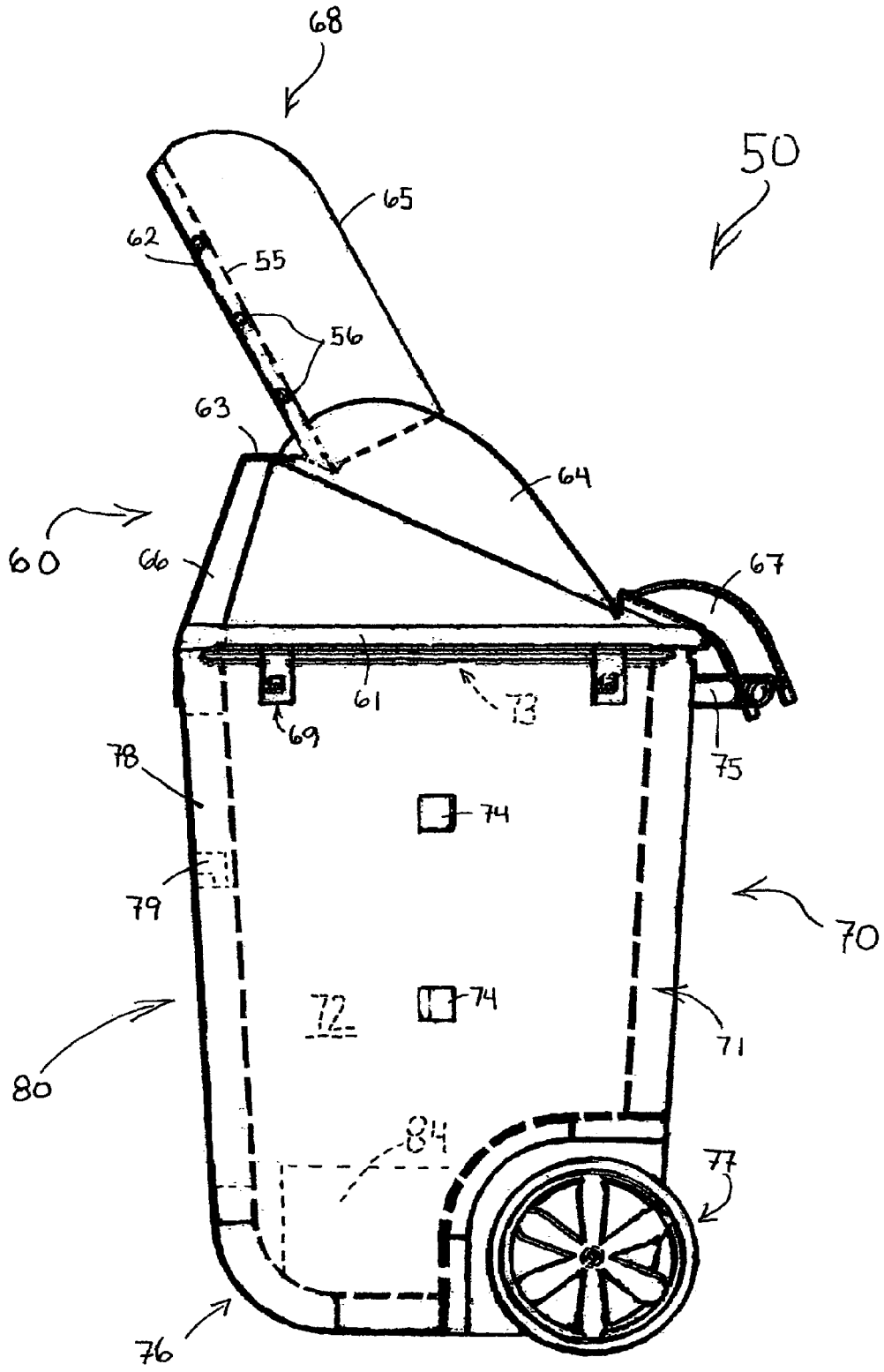
FIG. 6 is an perspective view from the side illustrating one exemplary embodiment of a collection system, the collection system is oriented in a vertical position relative to the floor and features a lid assembly coupled to a container assembly.

Referring to FIG. 1, the lid assembly 1 further includes a pair of guide flaps 7. Each guide flap 7 is coupled to and extends outwardly at an angle from each panel riser 3. In operation, as the collection panel 6 is engaged in an extended position, the pair of guide flaps 7 act to contain articles along the pathway from the collection panel 6 through the lid assembly 1 to the storage cart such that articles are deflected from each guideflap 7 and redirected toward the storage cart opening. The lid assembly 1 may optionally include at least one lift grip 8 coupled to the lid assembly base structure 2. Operatively, the at least one lift grip 8 facilitates ease of orientation of the storage cart in either a vertical or a horizontal position as shown in FIGS. 6 and 7 respectively.

The lid assembly 1 may be manufactured either as an add-on to existing standard storage carts or integrated within a collection system including a container assembly. In one exemplary embodiment, the lid assembly 1 may be composed of a flexible, rigid material such as polymer. Regarding manufacturing, the lid assembly 1 may be formed from standard molding techniques, such as injection molding, blow molding, and similar techniques.

Figure 2:
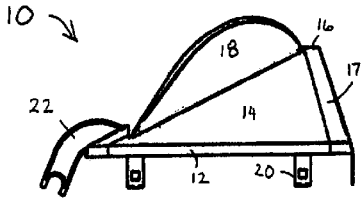
FIG. 2 is an orthographic view from the side illustrating one exemplary embodiment of a lid assembly.

FIG. 2 illustrates one aspect, among others, of a lid assembly 10 shown from the side. The lid assembly 10 includes a lid assembly base structure 12. The lid assembly 10 includes a fastening device 20 extending outwardly from the lid assembly base structure 12. Moreover, the lid assembly 10 further includes a panel riser 14 and a platform riser 17, each extending outwardly from the lid assembly base structure 12 and coupled to one another. A support platform 16 is formed at a distal end of the platform riser 17.

As shown in FIG. 2, the support platform 16 and the platform riser 17 extend inwardly toward the center of the lid assembly base structure 12. Accordingly, in an extended position, a greater degree of inward slant achieved by the support platform 16 and platform riser 17 establishes a steeper slope for articles passing beyond the support platform 16 toward the opening. A steep slope formed by a support platform and platform riser creates a barrier for trapping articles of larger size from being redirected back through a support platform and along a collection panel coupled thereto. The ability of the lid assembly 10 for trapping articles of a particular size is directly proportional to the steepness of the slope created by the support platform 16 and platform riser 17 as they extend toward the center of the lid assembly base structure 12.

The lid assembly 10 includes a pair of guide flaps 18 each coupled to a corresponding panel riser 14. Optionally, the lid assembly 10 may include at least one lift grip 22 coupled to the lid assembly base structure 12.

Figure 3:
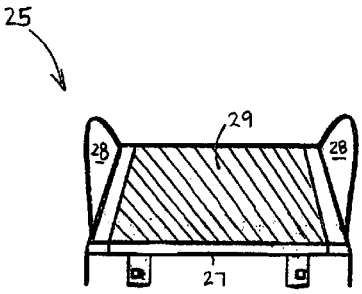
FIG. 3 is an orthographic view from the front illustrating one exemplary embodiment of a lid assembly.

FIG. 3 illustrates one aspect, among others, of a lid assembly 25 as shown from the front for attachment to a storage cart. The lid assembly 25 includes a lid assembly base structure 12. The lid assembly 25 further includes a collection panel 29. The collection panel 29 is shown in FIG. 3 in a retracted position for operatively covering an opening provided by the storage cart as the lid assembly 25 is situated thereon. The lid assembly 25 also shows a pair of guideflaps 28 for ensuring that articles do not escape beyond the lid assembly 25.

Figure 4:
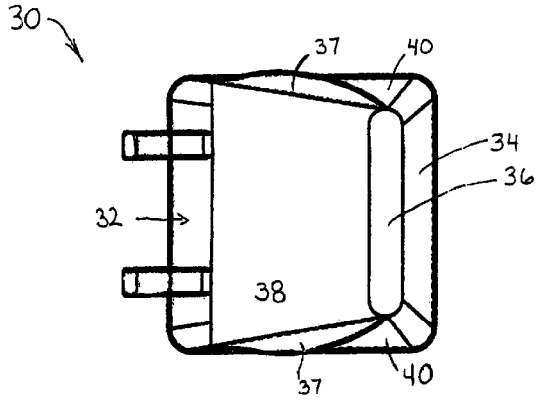
FIG. 4 is an orthographic view from the top illustrating one exemplary embodiment of a lid assembly.

FIG. 4 illustrates one aspect, among others, of a lid assembly 30 for attachment to a storage cart (not shown) as viewed from the top. The lid assembly 30 includes a lid assembly base structure 32, a platform riser 34, and a pair of opposingly positioned panel risers 40 each extending outwardly from the lid assembly base structure 32. Optionally, a guide flap 37 is coupled to a corresponding panel riser 40.

The lid assembly 30 of FIG. 4 further shows a support platform 36 formed by the platform riser 34. Accordingly, a collection panel 38 is hingedly secured to the support platform 36. The collection panel 38 is shown in FIG. 4 in a retracted position for covering an opening formed by the storage cart.

Figure 5:
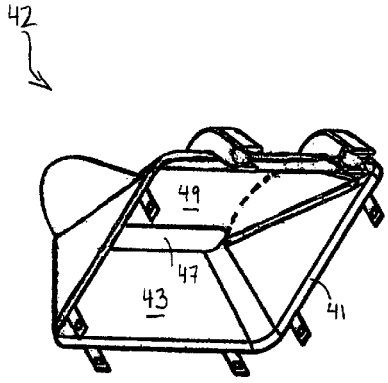
FIG. 5 is an isometric view from the bottom illustrating one exemplary embodiment of a lid assembly.

FIG. 5 illustrates one aspect, among others, of a lid assembly 42 for attachment to a storage cart (not shown) as shown from the bottom. The lid assembly 42 includes a lid assembly base structure 41. A platform riser 43 extends outwardly from the lid assembly 42 toward the center of the lid assembly base structure 41. The platform riser 43 forms a support platform 47.

In one exemplary embodiment, a collection panel 49 is hingedly attached to the support platform 47. It should be added that in one exemplary embodiment, the collection panel 49 may bow outwardly from the juncture at the support platform 47 so as to resemble a "scoop-like" configuration. Operatively, in an extended position, articles are directed upwardly along the collection panel 49 to the support platform 47. The height of the support platform 47 relative to the floor establishes a drop whereby the platform riser 43 receives the articles and directs them downwardly to the opening formed by storage cart positioned adjacent to the lid assembly base structure 41.

FIG. 6 illustrates one aspect, among others, of a collection system 50 for receiving articles. Generally, the collection system 50 features a lid assembly 60 coupled to a container assembly 70. In FIG. 6, the collection system 50 is shown in a vertical position relative to the floor. Moreover, for purposes of illustration, the lid assembly 60 is rendered in an extended position.

The lid assembly 60 includes a lid assembly base structure 61. A fastening device 69 is provided for securing the lid assembly base structure 71 to the container assembly 70.

The lid assembly 60 includes a platform riser 66. The platform riser 66 extends outwardly from the lid assembly 60 toward the center of the lid assembly base structure 61. The platform riser 66 forms a support platform 63. As shown, the support platform 63 is formed at a distal end of the platform riser 66.

The lid assembly 60 further includes a collector arrangement 68 pivotally attached to the support platform 63. The collector arrangement 68 includes a collection panel 62. The collection panel 62 is shown in an extended position that defines a pathway for directing articles from the collection panel 62 through the lid assembly base structure 71 to the container assembly 70. The collector arrangement 68 further includes a pair of collector guidewalls 65. Each collector guidewall 65 is secured to the collector panel 62 and spaced apart in parallel with the other collector guidewall.

The lid assembly 60 further provides a pair of guideflaps 64. As shown in FIG. 6, each guideflap 64 overlaps against a corresponding collector guidewall 65. Accordingly, the lid assembly 60 provides walled support for directing articles through the lid assembly 60 along the collection panel 62 to the support platform.

Optionally, as operatively discussed in greater detail below, the collector arrangement 68 includes a plurality of retainment strips 56 disposed on the collection panel 62 and a guide channel 55 formed by each collector guidewall 65 adjacent to the collection panel 62. The lid assembly 60 may further include at least one lift grip 67 coupled to the lid assembly base structure 61.

The container assembly 70 includes a container body 71. The container body 71 includes a storage chamber 72. The storage chamber 72 defines an opening 73 for receiving articles therethrough. The container body 71 forms a tilt glide 76. Operatively, the tilt glide 76 provides a pivot point for orienting the container body 71 in either a horizontal or a vertical position.

As shown in FIG. 6, the container assembly 70 includes a pair of wheels. In one exemplary embodiment, the container assembly 70 includes more than two wheels. Alternatively, the container assembly 70 may feature no wheels.

Optionally, the container assembly 70 further includes a container handle 75. The container handle 75 extends outwardly from the container body 71 and is coupled to the at least one lift grip 67.

The container assembly 70 may further include a utility compartment 84 for storing items separate from those articles generally within the storage chamber 72. Illustratively, for a container assembly used in lawn and gardening applications, a utility compartment may store extra empty bags for future use.

The container assembly 70 may include a utility holder 74 disposed on the container body 71. Operatively, the utility holder 74 may secure such items as lawn and gardening equipment such as a rake or shovel, as well as maintenance and custodial equipment, such as a broom or mop, securely to the container body 71.

As shown in FIG. 6, the container body 71 features a floor-interface portion 80. Operatively, as the container body 71 is oriented in a horizontal position, the floor-interface portion 80 directly contacts the floor. Accordingly, in one exemplary embodiment, the floor-interface portion 80 may include at least one roller wheel (not shown) extending outwardly from the container body 71 and in contact with the floor. The at least one roller wheel facilitates ease of horizontal movement along the floor as the collection system 50 is operated in a horizontal position. Optionally, the floor-interface portion 80 includes an access door 78 to the storage chamber 72. As shown in FIG. 6, the access door 78 may include a handle 79.

FIG. 7 illustrates one aspect, among others, of a collection system 100 for receiving articles. Generally, the collection system 100 includes a lid assembly 120 and a container assembly 140 coupled to one another.

As shown in FIG. 7, the collection system 100 is oriented in a horizontal position and in contact with the floor. Accordingly, the collection system 100 includes a collector arrangement 125 arranged in an extended position. In the extended position, articles are directed along a pathway from the floor upwardly across the collector arrangement 125 and downwardly through the lid assembly 120 to an opening 143.

The container assembly 140 includes a container body 142. The container body 142 includes a storage chamber 144. As shown in FIG. 7, the storage chamber 144 defines the opening 143 for receiving articles. Optionally, at least one liner bag opener 149 may be disposed on the opening 143. In operation, the at least one liner bag opener 149 ensures that a liner bag conforms to the opening 143 so that articles are directed through the opening 143 and into the liner bag positioned within the storage chamber 144.

The container assembly 140 further includes a step-on lever 150 coupled to the container body 142. The container assembly 140 further includes a container handle 146. The container handle 146 extends outwardly from the container body 142 and is coupled to a pair of lift grips 131.

In operation, a user's foot is typically placed on to the step-on lever 150 to assist in orienting the collection system 100 from the horizontal position as shown in FIG. 7 to an upright or vertical position similar to that of FIG. 6. During this orientation, the lift grips 131 may be accessed to facilitate ease of reorientation, especially in the condition of when the storage chamber 144 is filled with heavy articles.

The lid assembly 120 includes a lid assembly base structure 122. The lid assembly 120 includes a fastening device 133 for securing the lid assembly base structure 122 to the container assembly 140. The lid assembly 120 includes a platform riser 134 extending outwardly from the lid assembly 120 toward the center of the lid assembly base structure 122. The platform riser 134 forms a support platform 124 at a distal end. Similarly, a pair of panel risers 123 each extend outwardly from the lid assembly base structure 122 and are coupled to the platform riser 134 at opposing ends of the platform riser 134.

The lid assembly base structure 122 includes the collector arrangement 125. As shown in FIG. 7, the collector arrangement 125 includes a collection panel 126. In one exemplary embodiment, the collection panel 126 is flat. In one exemplary embodiment, the collection panel 126 is curved.

The collection panel 126 is fastened to the support platform 124 as shown in FIG. 7. As it extends toward the center of the lid assembly base structure 122, the support platform 124 is positioned in parallel with the lid assembly base structure 122. In one exemplary embodiment, the support platform is positioned substantially parallel to the support platform 124.

In effect, the inward slant provided by the platform riser 134 and the parallel positioning of the support platform 124 with respect to the lid assembly base structure 122 functions as a barrier for confining the movement of articles along a one-way path. Specifically, as opposed to escaping back through the collection panel 126, the inward slant provided by the platform riser 134 and parallel positioning of the support platform 124 enables various articles to slide downwardly along the platform riser 134 to the opening 143. Therefore, in operation, articles are directed along a pathway from the floor upwardly across the collection panel 126, downwardly from the support platform 124, downwardly across the platform riser 134 and the lid assembly base structure 122 to the opening 143 of the storage chamber 144 for storage therein. As it is positioned in parallel with the lid assembly base structure 122, the support platform 124 elevates the collection panel 126 far above the floor so as to facilitate a ramp-like effect for the collection panel 126 and to provide a barrier for one-way article movement.

The collector arrangement 125 includes a pair of parallely spaced collector guidewalls 127. Each collector guidewall 127 is coupled to the collection panel 126. The lid assembly 120 further includes a pair of guideflaps 130. Each guideflap 130 is respectively coupled to the panel riser 123. As shown in FIG. 7, each guideflap 130 overlaps against a respective collector guidewall 127.

The collector arrangement 125 further includes a plurality of retainment strips 129. The plurality of retainment strips 129 are disposed on the collector panel 126. The plurality of retainment strips 129 provide at least two operative features. First, the retainment strips 129 act as barriers for preventing articles from sliding down the collection panel 126 while in the extended position. Secondly, the retainment strips 129 act as collectors of residual articles such as material and debris. For example, in a lawn and gardening application, retainment strips may collect residual articles, such as small leaves, twigs, clippings, and soil as mulch is primarily directed across a collector arrangement.

Shown in FIG. 7, the collector arrangement 125 further includes a pair of guide channels 128 positioned between the collection panel 126 and each respective collector guidewall 127. Each guide channel 128 acts as a spring for permitting a respective collector guidewall 127 to resiliently push against the corresponding guideflap 130. Moreover, in addition to the collection panel 126, each guide channel 128 promotes movement of articles along the guidewalls 127 toward the support platform 124.

Generally, in operation, articles are removed from the floor into a storage chamber 144 as follows. The collection system 100 is oriented in a horizontal position and in contact with the floor. In the horizontal position, the collection panel 126 is arranged in an extended position and in contact with the floor. A pathway is thereby created for directing articles from the floor upwardly across the collection panel 126 to the support platform 124 and then downwardly along platform riser 134 through the lid assembly base structure 122 to the opening 143.

After all the desired articles are removed from the floor, the collection system 100 may be oriented in a vertical position. Accordingly, with the assistance of gravitational forces, the articles near the opening 143 are directed further into the storage chamber 144 of the container body 142. In other words, as the collection system is reoriented from a horizontal to a vertical position with respect to the floor, articles are shifted from the opening 143 toward the bottom of the container assembly 140.

In the vertical position, the collection panel 126 is arranged in a retracted position. In the retracted position, the collection panel 126 covers entry through the opening 143. It should be added that, as the collection panel 126 is in the extended position, residual articles collected from the retainment strips 129 may be directed along the collection panel 126 through the lid assembly base structure 122 to the opening 143. Moreover, articles may be directed along the collector guidewall 127 and the corresponding guideflap 130 toward the opening 143.

Although the present invention has been described in detail, it should be understood that various changes, substitutions, and alterations could be made hereto without departing from the spirit and scope of the invention as defined by the appended claims.

I claim:

1. A collection system for receiving articles, the collection system comprising:

a container assembly, the container assembly including a pair of wheels attached thereto, and including a container body the container body including a storage chamber, the storage chamber defining an opening for receiving articles; and a lid assembly coupled to the container assembly, the lid assembly including a lid assembly base structure, a fastening device for securing the lid assembly base structure to the container assembly, a platform riser extending outwardly from the lid assembly toward the center of the lid assembly base structure, the platform riser forming a support platform, the support platform formed at a distal end of the platform riser and parallel to the lid assembly base structure; and a collector arrangement pivotally attached to the support platform, the collector arrangement including a collection panel, in a retracted position, the collection panel covers the opening, in an extended position, the collection panel exposes the opening and defines a pathway for directing articles from the collection panel, through the lid assembly base structure to the opening.

2. The collection system according to claim 1 wherein the container body includes an access door to the storage chamber.

3. The collection system according to claim 1 wherein the container body forms a tilt glide for orienting the container body in either a horizontal or a vertical position.

4. The collection system according to claim 1 wherein the container assembly further includes a step-on lever coupled to the container body.

5. A lid assembly for attachment to a storage cart, the storage cart forming an opening for receiving articles, the lid assembly comprising:

a lid assembly base structure;

a fastening device for securing the lid assembly base structure to the storage cart;

a pair of panel risers, each of which extend outwardly from said lid assembly base structure towards its center, a pair of guideflaps, wherein each of said guideflaps are coupled to and extend outwardly at an angle from each panel riser, a platform riser extending outwardly from the lid assembly toward the center of the lid assembly base structure, the platform riser forming a support platform, the support platform formed at a distal end of the platform riser and parallel to the lid assembly base structure; and a collector arrangement pivotally attached to the support platform, the collector arrangement including a collection panel, in a retracted position, the collection panel covers the opening, in an extended position, the collection panel exposes the opening and defines a pathway for directing articles from the collection panel, through the lid assembly base structure to the opening.

6. The lid assembly according to claim 5 wherein the fastening device is coupled to the lid assembly base structure and to the storage cart at the opening.

7. The lid assembly according to claim 5 wherein the collector arrangement further includes a pair of collector guidewalls.

8. The lid assembly according to claim 7 wherein each collector guidewall is secured to the collection panel and spaced apart in parallel with the other collector guidewall.

9. The lid assembly according to claim 5 wherein each guideflap overlaps against a corresponding collector guidewall.

10. The lid assembly according to claim 5 wherein the collector arrangement further includes a plurality of retainment strips disposed on the collection panel.

11. The lid assembly according to claim 5 wherein the lid assembly further includes at least one lift grip coupled to the lid assembly base structure.

12. A method for removing articles from a floor into a storage cart, the storage cart forming an opening for receiving articles, the method comprising the steps of:

orienting the storage cart in a horizontal position and in contact with the floor, the storage cart coupled to a lid assembly, the lid assembly including a lid assembly base structure, a platform riser extending outwardly from the lid assembly toward the center of the lid assembly base structure, the platform riser forming a support platform, the support platform formed at a distal end of the platform riser and parallel to the lid assembly base structure, and a collector arrangement pivotally attached to the support platform, the collector arrangement including a collection panel;

arranging the collection panel in an extended position;

directing articles along a pathway from the floor, across the collection panel, through the lid assembly base structure to the opening; and directing articles along a collector guidewall secured to the collection panel;

wherein said step of directing articles along a collector guidewall further includes the step of directing articles along a guideflap overlapping against the corresponding collector guidewall.

* * * * *